US007677229B2

(12) United States Patent
Lemke et al.

(10) Patent No.: US 7,677,229 B2
(45) Date of Patent: Mar. 16, 2010

(54) ADAPTIVE OIL SEPARATOR

(75) Inventors: Kai-Uwe Lemke, Ulm (DE); Dieter Grafl, Ulm (DE)

(73) Assignee: Dana Automotive Systems Group, LLC, Toledo, OH (US)

( * ) Notice: Subject to any disclaimer, the term of this patent is extended or adjusted under 35 U.S.C. 154(b) by 379 days.

(21) Appl. No.: 11/978,774

(22) Filed: Oct. 30, 2007

(65) Prior Publication Data

US 2008/0105494 A1 May 8, 2008

(30) Foreign Application Priority Data

Oct. 30, 2006 (DE) ..... 10 2006 051 143

(51) Int. Cl.
*F01M 13/04* (2006.01)

(52) U.S. Cl. ..... 123/574

(58) Field of Classification Search ..... 123/572–574
See application file for complete search history.

(56) References Cited

U.S. PATENT DOCUMENTS 4,686,952 A * 8/1987 Zeigler et al. ..... 123/572
6,505,615 B2 * 1/2003 Pietschner ..... 123/572
2005/0061305 A1 * 3/2005 Pietschner ..... 123/572
2005/0279336 A1 * 12/2005 Dworatzek et al. ..... 123/572

FOREIGN PATENT DOCUMENTS

DE 100 44 922 B4 9/2004
DE 20 2004 019 787 U1 6/2006
DE 10 2005 038257 A1 2/2007

* cited by examiner

*Primary Examiner*—Marguerite J. McMahon
(74) *Attorney, Agent, or Firm*—Marshall & Melhorn, LLC

(57) ABSTRACT

An oil mist separator has a pressure regulator valve which is located in the blow-by line downstream of the oil mist separator element in the flow direction of the gas. The pressure regulator valve has a bias so that it opens above a specified pressure difference between the blow-by line and a neighboring chamber. Located around the oil mist separator element is a bypass line which has a bypass valve. The bypass valve has a bias that causes the bypass valve to close below a specified pressure difference between the suction side and the pressure side of the oil mist separation element. The pressure regulator valve and the bypass valve are connected with each other so that the pressure regulator valve, as it closes, increases the bias of the bypass valve.

14 Claims, 6 Drawing Sheets

ADAPTIVE OIL SEPARATOR

RELATED APPLICATIONS

This application claims priority from German Patent Application No. DE 10 2006 051 143.3 filed on Oct. 30, 2006 which is incorporated by reference in its entirety.

FIELD OF THE INVENTION

This invention relates to an oil mist separator, a ventilation system and an internal combustion engine in which an oil mist or oil droplets are to be separated from a gas.

BACKGROUND OF THE INVENTION

Oil mist separators of this type are used in particular for the separation of oil mists and oil droplets from blow-by gases in an internal combustion engine. The blow-by gases are conventionally transported out of the crankcase by means of a ventilation line to the intake tract of the engine where they are recycled to the combustion process. However, it is necessary to first remove from the blow-by gases any oil that they may be carrying.

Depending on the operating conditions of the internal combustion engine, situations can thereby occur in which critical levels of operation are reached. On one hand, an excessive vacuum in the intake tract can cause the crankcase to be completely evacuated. An insufficient vacuum in the intake tract or an excessive pressure drop in the ventilation line can cause an overpressure to occur in the crankcase. However, an overpressure in the crankcase with respect to the atmospheric pressure cannot be allowed to occur.

Therefore, in the prior art, almost every internal combustion engine of the prior art includes pressure regulator valves in the blow-by path (ventilation line), which protect the crankcase from unallowably high vacuum. These valves close when the suction-side vacuum becomes too high and thereby cause an additional pressure drop in the blow-by line.

If only a low vacuum or an unallowably high pressure drop occurs in the intake line, for example on account of the clogging of one of the oil mist separators located in the intake line, bypass lines are provided in the ventilation line which bypass the corresponding locations, i.e. the oil mist separators. These bypass lines are closed by means of bypass valves which respond only when the pressure difference across a separator becomes too great. As a result of this bypassing, when the bypass valve is open, the vacuum of the intake tract of the engine is fully available in the crankcase for the ventilation of the crankcase. In this manner, an inflation of the crankcase is prevented.

DE 100 44 922 B4, for example, discloses a pressure regulator valve which is controlled by means of the pressure prevailing in the crankcase. The manipulated variable is thereby the pressure differential between the crankcase and the outside atmospheric pressure (constant pressure).

If the pressure in the crankcase increases, for example under operating conditions in which increased blow-by occurs, the pressure regulator valve opens again to effect an improved ventilation of the crankcase.

DE 20 2004 019 787 U1 describes an additional example of an oil mist separator in the blow-by ventilation line of an internal combustion engine. In this case a pressure regulator valve is located upstream of the oil mist separator. If the oil mist separator becomes clogged, there is a bypass line around the pressure regulator valve and the oil mist separator, which for its part is connected with a bypass valve. One problem with this example of the prior art is that the bypass valve is independent of the operating condition of the engine and the resulting intake vacuums. Therefore the bypass valve cannot react and adapt its response to different operating conditions.

SUMMARY OF THE INVENTION

The object of this invention is therefore to make available an oil mist separator, a ventilation system with an oil mist separator and an internal combustion engine and its use, in which there is an adaptive regulation of the oil mist separator.

The oil mist separator claimed by the invention has a line for the transport of a gas which can be, for example, the ventilation line of a ventilation system in the bypass system of an internal combustion engine. Located in the line is an oil mist separation element, such as a spiral-shaped helix, a cyclone, an impact separator or any other arbitrary type of separator that can be used for the separation of oil mist and oil droplets from a flowing gas.

Downstream of the oil mist separation element, i.e. downstream in the direction of the gas flow, there is a pressure regulator valve which has a bias that opens the pressure regulator valve above a specified pressure in the line, in particular the pressure in the line between the oil mist separation element and the pressure regulator valve. In this manner, there is a biased valve which is fully open under normal operating conditions. A bias of this type can be achieved, for example, by realizing the valve in the form of a membrane-regulated valve. The membrane can then be located between the line and a constant pressure such as atmospheric pressure, for example. If the pressure difference between the line and this pressure decreases, the membrane exerts increased pressure on a valve body which increasingly closes the valve. By means of this pressure regulator valve it is possible to protect the inlet side of the line, such as a crankcase for example, against an excessive vacuum from an intake tract of an engine located on an outlet side of the line.

On the oil mist separator claimed by the invention, there is further a bypass line which bypasses the oil mist separator located in the line. This bypass line has a bypass valve which is closed under normal operating conditions. For this purpose a bias is provided which closes the valve below a specified pressure difference between the suction side and the pressure side of the oil mist separation element. Only when there is a high pressure difference between the suction side and the pressure side of the oil mist separator element does the bypass valve open and release an additional flow path for the gas from the inlet side to the outlet side. A condition of this type can occur, for example, if the oil mist separator is frozen. That would otherwise result in an unacceptable inflation of the crankcase.

For its part, one or more additional oil mist separation elements can be located in the bypass line. It is also possible, however, to provide only one bypass line to realize a bypassing of the oil separation element in the ventilation line with the smallest possible pressure drop.

A decisive factor in this invention is that the pressure regulator valve and the bypass valve are functionally coupled or connected to each other. When the pressure regulator valve closes, it thereby increases the bias of the bypass valve. Therefore if the pressure regulator valve is closed, which normally occurs at a very high intake vacuum of the intake tract, the bias of the bypass valve is simultaneously increased. Under operating conditions of this type, the high vacuum of the intake tract is sufficient to empty the crankcase of the blow-by via the oil mist separation elements in the ventilation line, even if the blow-by flow is very large or the oil mist separation element, because of partial clogging, produces a large pressure drop. Therefore a bypass valve is provided that opens later at a high suction pressure to effectively clean the blow-by flow under these conditions, too, before uncleaned gas is transported through the bypass valve and the bypass line into the intake tract.

One particularly advantageous embodiment of this invention uses a membrane-regulated valve as the pressure regulator valve, in which the membrane is pulled toward the valve seat, and a valve body is thereby moved toward the valve seat to make the flow gap in the valve smaller if the suction vacuum is too high. Thus the resistance in the valve, i.e. the pressure drop, is increased and it becomes possible to reliably prevent the crankcase from being totally evacuated. At low suction vacuums, the membrane is in contact against the cap of the pressure regulator valve and opens the valve all the way.

The membrane is supported on a spring that biases the membrane toward the cap of the pressure regulator valve.

Also provided is a bypass valve in which a valve body is pressed by a spring onto the aperture of the bypass valve. The bias of the spring consequently determines the force and thus the pressure difference necessary to lift the valve body of the bypass valve out of its seat and thus to open the bypass valve. In one particularly advantageous variant, the bypass valve can be located immediately next to the pressure regulator valve. In this manner, when there is a high pressure difference in the intake tract, the pressure regulator valve is increasingly closed and simultaneously the bias of the bypass valve is increased. When the vacuum in the intake tract is high, the ventilation of the crankcase is guaranteed even in the event of a high blow-by flow or a partial clogging of the oil mist separator element.

The switch point of the two valves is thereby determined on the basis of the coordination of the surface areas of the intakes, the valve bodies, the membrane characteristics (active surface area, thickness, material, shape, stiffness) and the strength(s) of the spring or springs used.

In an additional advantageous variant, at least one separation element is also integrated into the bypass. In this manner, an oil mist separation also occurs in the blow-by gases transported through the bypass. In this manner, completely uncleaned blow-by gas is prevented from getting into the intake tract. An arrangement of this type could also be called an adaptive oil mist separator, because different oil mist separation paths are opened as a function of the blow-by amount and the pressure conditions in the intake tract.

The oil mist separator claimed by the invention has a better control characteristic and a higher degree of separation than unregulated oil mist separators. The protection of the oil separator against failure is also improved. Because the valves (pressure regulator valve and bypass valve) are next to each other, the number of replacement parts required in the oil mist separator claimed by the invention is reduced, which results in easier installation and cost advantages.

One example of an oil mist separator of the type claimed by the invention is described below. Identical and similar components are identified by identical and similar reference numbers in all of the figures.

BRIEF DESCRIPTION OF THE DRAWINGS

The above, as well as other advantages of the present invention, will become readily apparent to those skilled in the art from the following detailed description when considered in the light of the accompanying drawings in which.

DETAILED DESCRIPTION OF THE PREFERRED EMBODIMENTS

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

Figure 1:
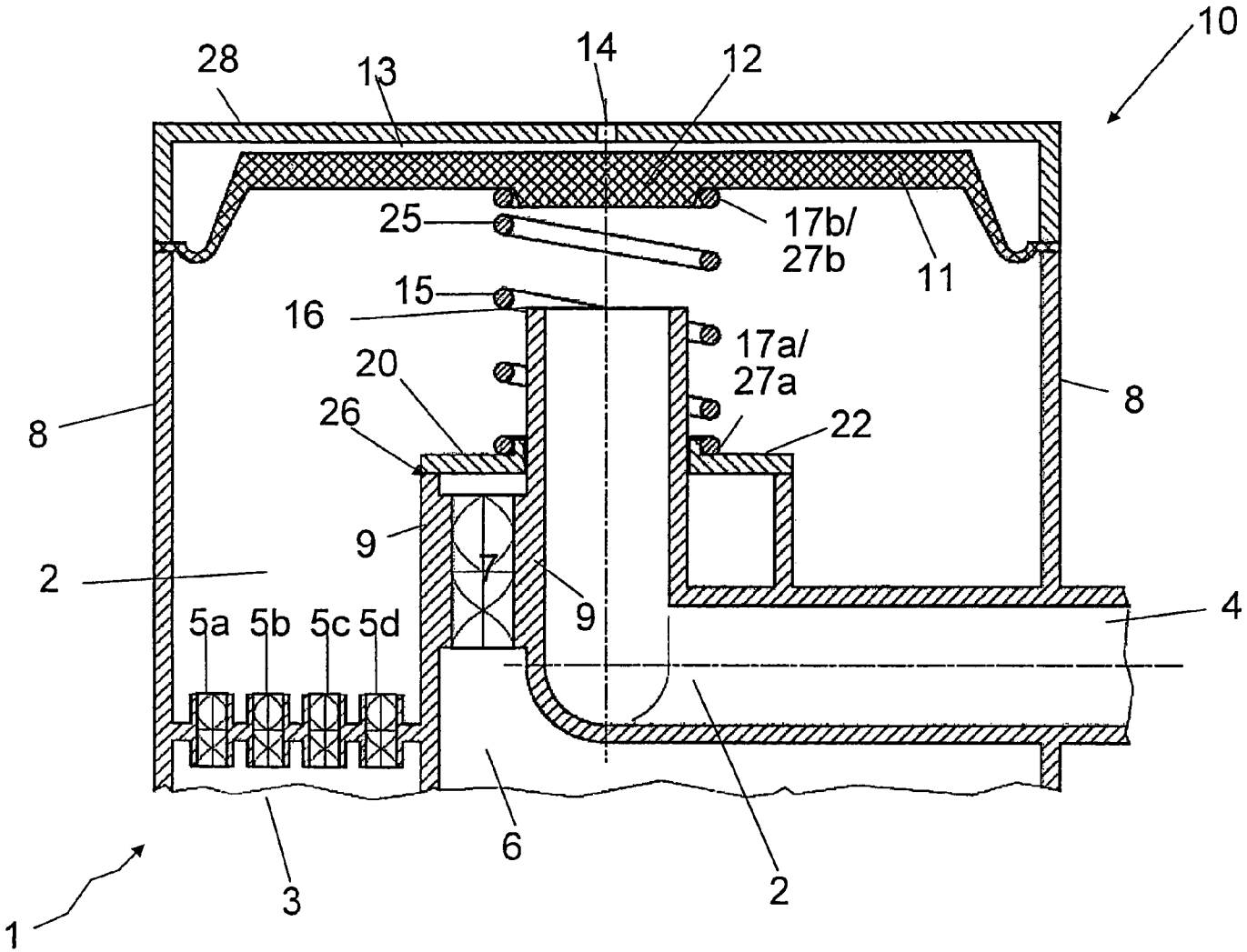
FIG. 1 shows one embodiment of an oil mist separator.

FIG. 1 shows an oil mist separator 1 claimed by the invention, which can be located in the ventilation line of an internal combustion engine between the crankcase and intake tract (blow-by line).

The oil mist separator 1 has a line 2, which can be part of the ventilation line of the internal combustion engine. This line 2 has an inlet 3 and an outlet 4. In the vicinity of the inlet 3 the line is realized in the form of a cylinder which has a center discharge in the vicinity of a pressure regulator valve 10.

Concentric to the line 2 there is a bypass line 6 which is in communication with the inlet of the line 2 on the inlet side and is closed with a bypass valve 20 on the outlet side. If the bypass valve 20 is opened, the gases that are flowing in the line 2 also flow via the bypass line 6 from the inlet side 3 via the bypass line 6 and the valve 20 and then, because the pressure regulator valve 10 is open, continue through the line 2 to the outlet 4.

Located at the inlet 3 of the line 2 are oil mist separation elements 5*a*, 5*b*, 5*c* and 5*d* in which the oil mist or oil droplets are removed from the gas flowing in the line 2. The bypass line 6 is used to bypass these oil separator elements 5*a*, 5*b*, 5*c* and 5*d*.

The line 2 has walls 8 which simultaneously form the housing for the pressure regulator valve 10. The boundaries of the bypass line 6 are defined by the walls 9. A portion of these walls forms the valve seat 16 of the pressure regulator valve 10.

The pressure regulator valve 10 has a regulating membrane 11 which presses on a valve body 12. The regulating membrane 12 is biased by means of a spring 15 toward the opening of the flow path through the valve. The spring 15 is supported on one hand on the membrane 11 and on the other hand on a valve body 22 of the bypass valve 20. Often a small plastic platelet is held between the spring 15 and the membrane 11, whereby the collar on the platelet prevents direct contact between the spring 15 and membrane 11, thereby counteracting the destruction of the membrane. The spring 15 therefore exerts a bias on one hand on the membrane 11 to open the pressure regulator valve 10 and simultaneously a bias on the valve body 22 of the bypass valve 20 to close the bypass valve 20.

The housing cover 28 and the membrane 11 form an additional chamber 13 which in the illustrated example is in communication via an opening 14 in the housing cover with the outside pressure (atmospheric pressure), which can be considered approximately constant. In this manner, the chamber 13 is continuously pressurized at an approximately constant pressure. Instead of atmospheric pressure, the chamber 13 can optionally also be pressurized at another pressure, for example at the pressure of another compartment of the internal combustion engine or of the vehicle. If the pressure in the line 2 increases, a smaller pressure difference between the pressure in the chamber 13 and the pressure in the line 2 is exerted on the membrane. The spring 15 thus moves the membrane 11 and also the valve body 12 upward and opens the pressure regulator valve 10. However, if a high vacuum is present in the line 2, for example on account of a high vacuum in the intake tract of the internal combustion engine, the pressure difference across the membrane 11 counteracts the force of the spring 15 and the valve body is moved downward so that the pressure regulator valve reduces the gas path from the inlet side 3 to the outlet side 4 of the line 2. Simultaneously, however, the bias on the valve body 22 of the bypass valve 20 increases, which means that the bypass valve is closed more firmly. In that case, a greater pressure drop across the oil mist separator elements 5*a* to 5*d* is necessary to open the bypass valve. Thus the higher vacuum that is present is utilized for an effective oil mist separation.

In the example of an oil mist separator claimed by the invention illustrated in FIG. 1, the spring 15 which creates the bias of the pressure regulator valve 10 is simultaneously used as the spring 25 to apply a bias to the bypass valve 20. The spring 15, 25 is therefore supported on one hand in bearings 17*a* and 17*b* on the bypass valve 20 and on the pressure regulator valve 10. These bearings therefore represent simultaneously the bearings for the bias springs of the bypass valve 20, which are provided with their own reference numbers 27*a*, 27*b*.

Embodiments are also conceivable in which the springs 15 and 25 are separate springs which are mounted in separate bearings 17*a*, 17*b* and 27*a*, 27*b* respectively. In that case, a transmission element is necessary to transmit the closing force of the pressure regulator valve to the bypass valve 20 in the form of a bias. In the illustrated example, the spring 15 or 25 simultaneously performs this transmission function. Progressive springs can also be used as an alternative.

FIGS. 2A to 2E illustrate the same oil mist separator as in FIG. 1, but in a side view offset by 90°.

Figure 2A:
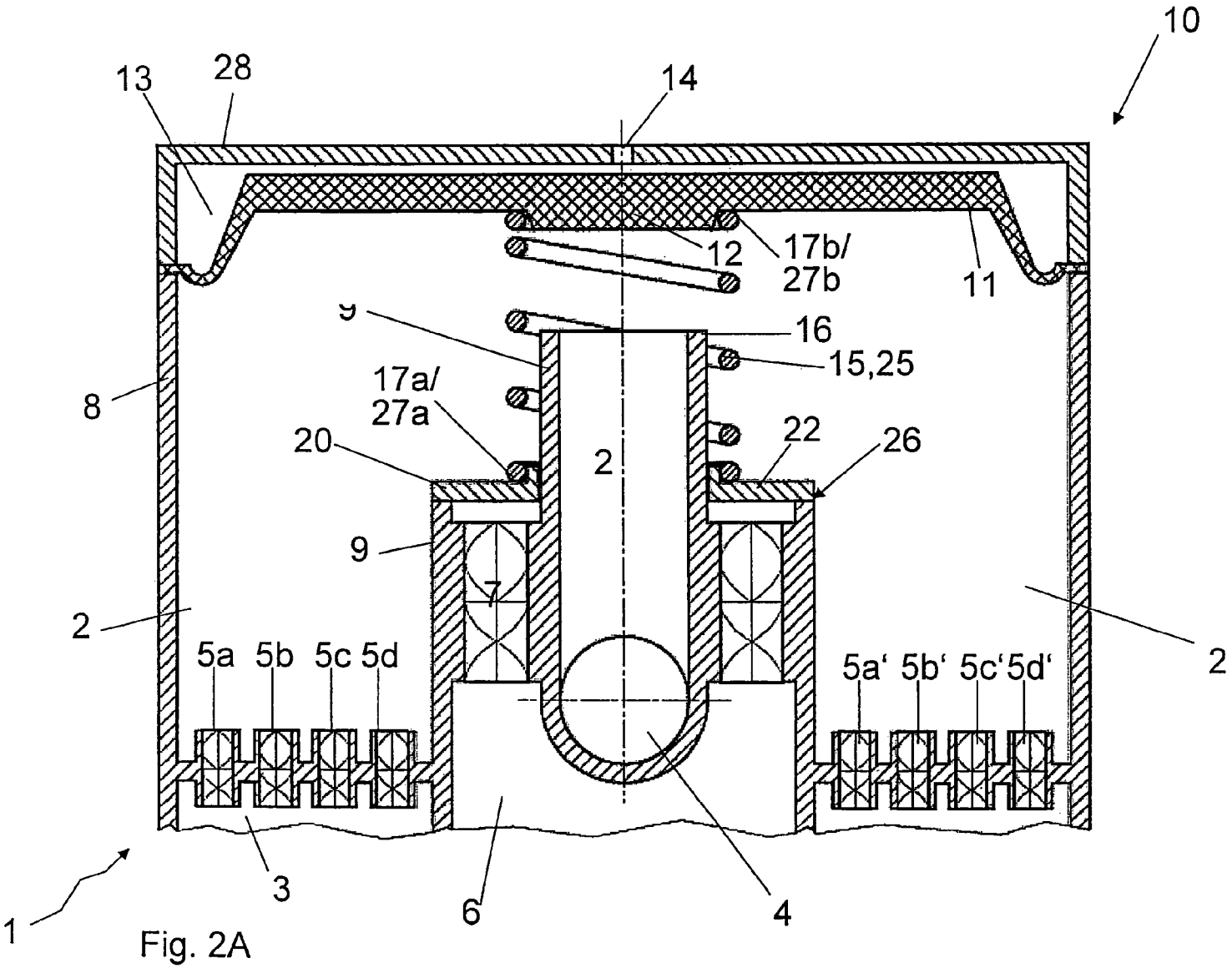
FIGS. 2A to 2E illustrate different operating conditions of the oil mist separator illustrated in FIG. 1.

FIG. 2A shows an operating condition in which the vacuum is low at the outlet 4 of the intake pipe vacuum, i.e. in the internal combustion engine. In this case, the pressure regulator valve 10 is opened to the maximum, because the pressure in the line 2 is approximately equal to the atmospheric outside pressure.

In the operating condition illustrated in FIG. 2A, the blow-by flow is also low, so that the pressure drop across the oil mist separator elements 5*a* to 5*d*, which are not shown here in any further detail, is also small. The bias of the spring 15 or 25 is in this case sufficient to both open the pressure regulator valve 10 to the maximum and to completely close the bypass valve 20.

Figure 2B:
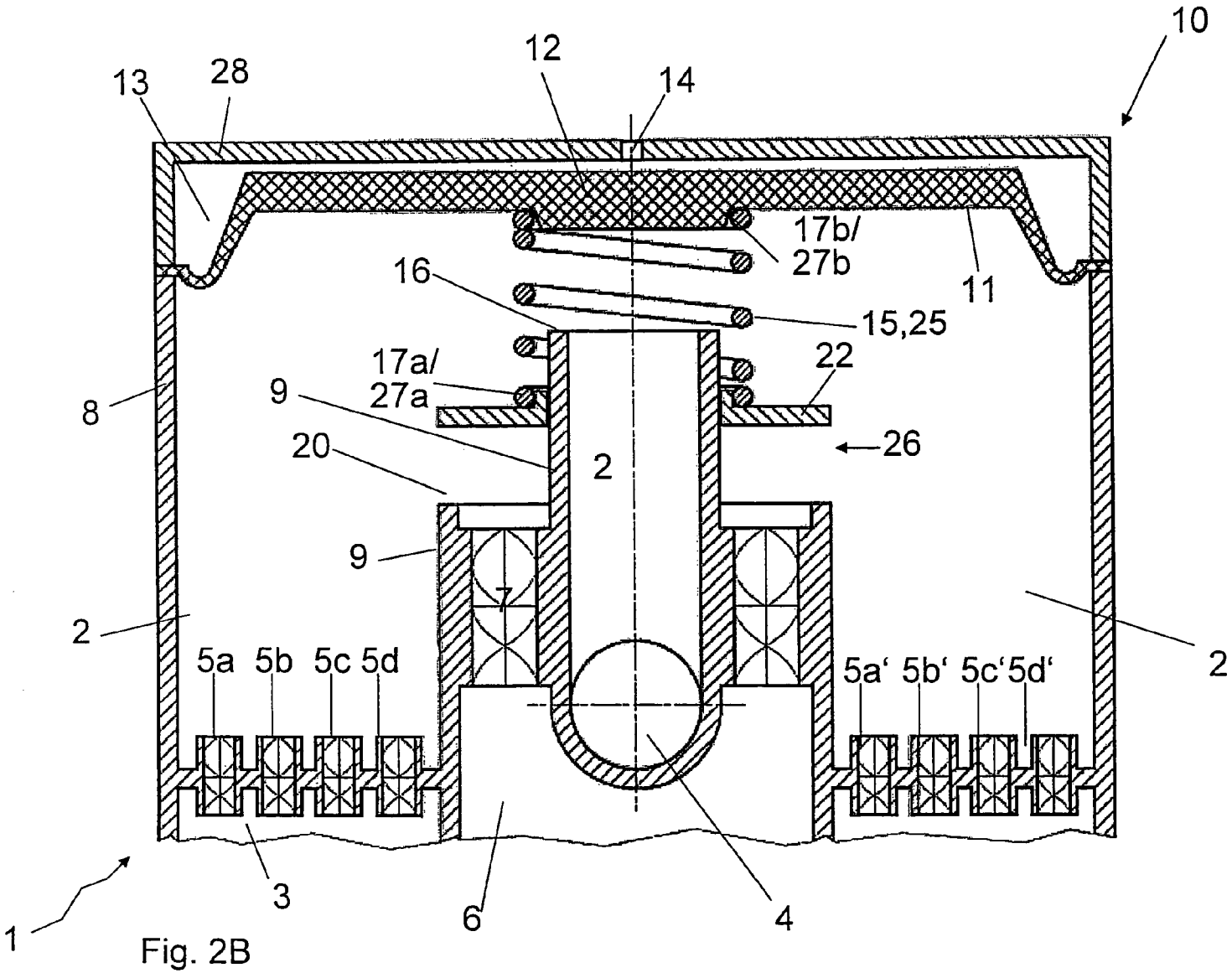

FIG. 2B shows an operating condition in which the intake pipe vacuum is low, but there is a very large blow-by flow. In this case, the pressure drop across the oil separator elements 5*a* to 5*d* is very large, so that a complete ventilation of the crankcase via the oil mist separator elements 5*a* to 5*d* would no longer be guaranteed. In this case, the pressure regulator valve 10 is also fully open, and the bypass valve 20 is also opened so that the crankcase gases (blow-by gases) can flow from the inlet side 3 to the outlet side 4 of the line 2 with a small pressure drop.

Figure 2C:
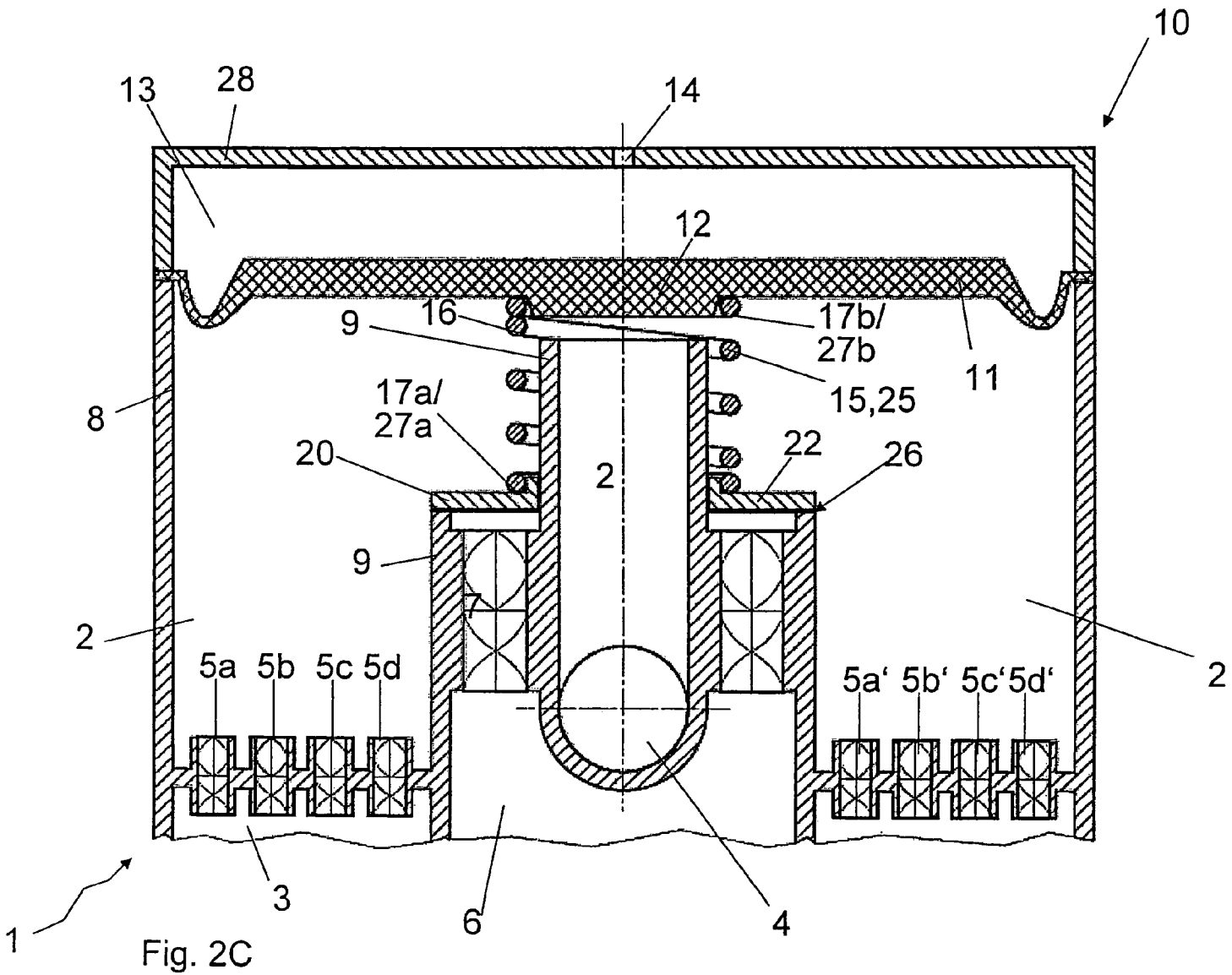

FIG. 2C illustrates an operating condition in which the intake pipe vacuum, i.e. the vacuum at the outlet 4, is very high, while the blow-by gas flow is low. To avoid the complete evacuation of the crankcase, in this operating condition the pressure regulator valve 10 is closed as far as possible, so that a large pressure drop occurs across the opening 16 of the pressure regulator valve 10. The intake pipe vacuum is therefore not transmitted in full to the crankcase, as a result of which there is a limited ventilation of the crankcase via the oil mist separator elements 5*a* to 5*d*. As a result of the closing of the pressure regulator valve 10, the spring 15, 25 is compressed so that the bias on the bypass valve 20 increases. The bypass valve 20 therefore remains securely closed.

Figure 2D:
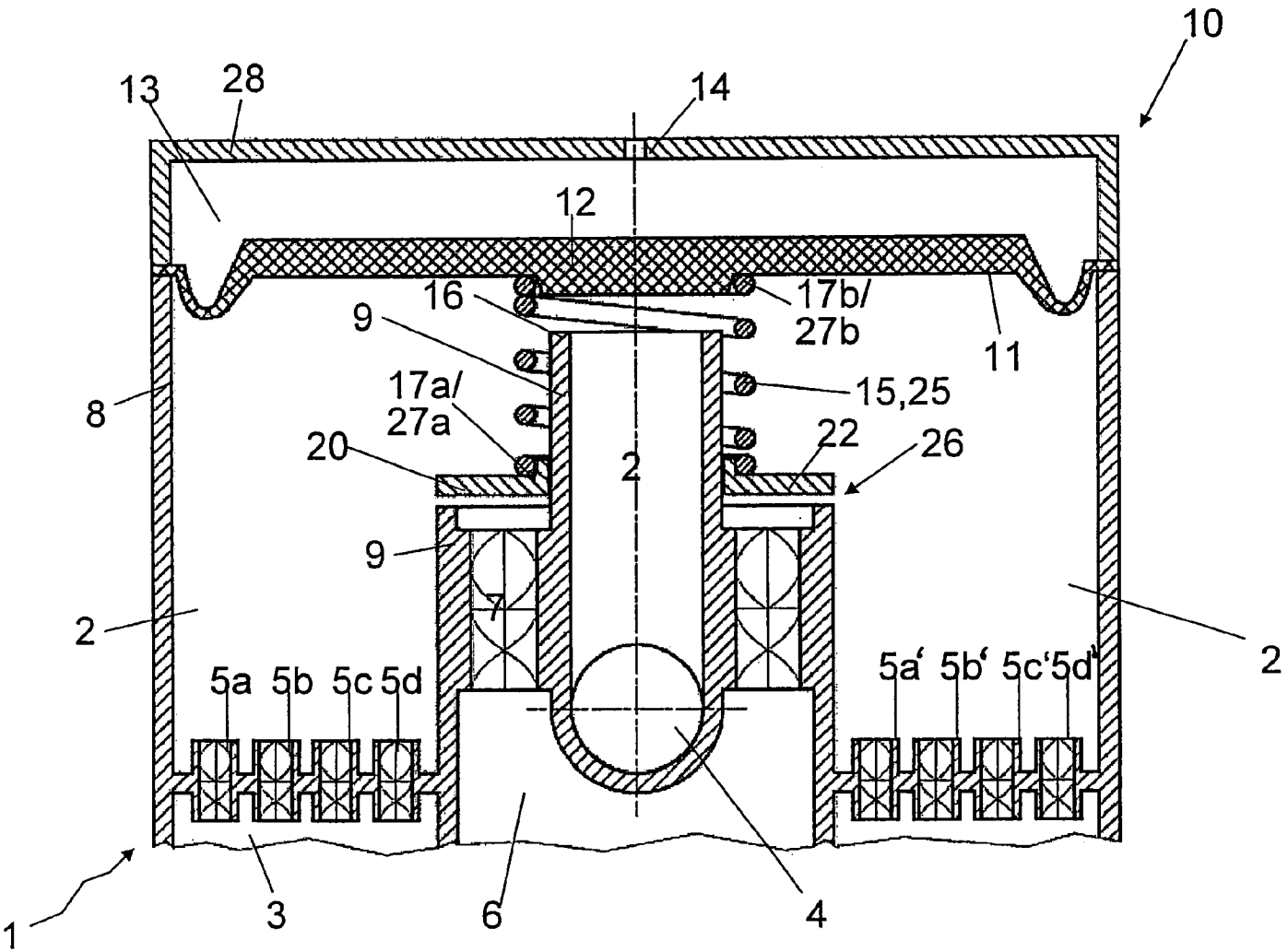

FIG. 2D shows an operating condition in which both the intake pipe vacuum and the blow-by gas flow are high. In this case, on account of the high intake pipe vacuum, the pressure regulator valve is closed (although not completely sealed), so that a reduced vacuum is present at the crankcase. On account of the high blow-by gas flow, however, there is a large pressure drop across the oil mist separator elements 5*a* to 5*d*, so that the bypass valve 20 is still slightly open. In this manner, by means of the valve opening 26 of the bypass valve 20, a connection is created between the uncleaned gas in the crankcase and the clean gas at the outlet 4 of the line 2.

If an additional oil mist separator element is located in the bypass line, there is also at least a partial or preliminary separation of oil droplets or oil mist in the bypass line 6.

Figure 2E:
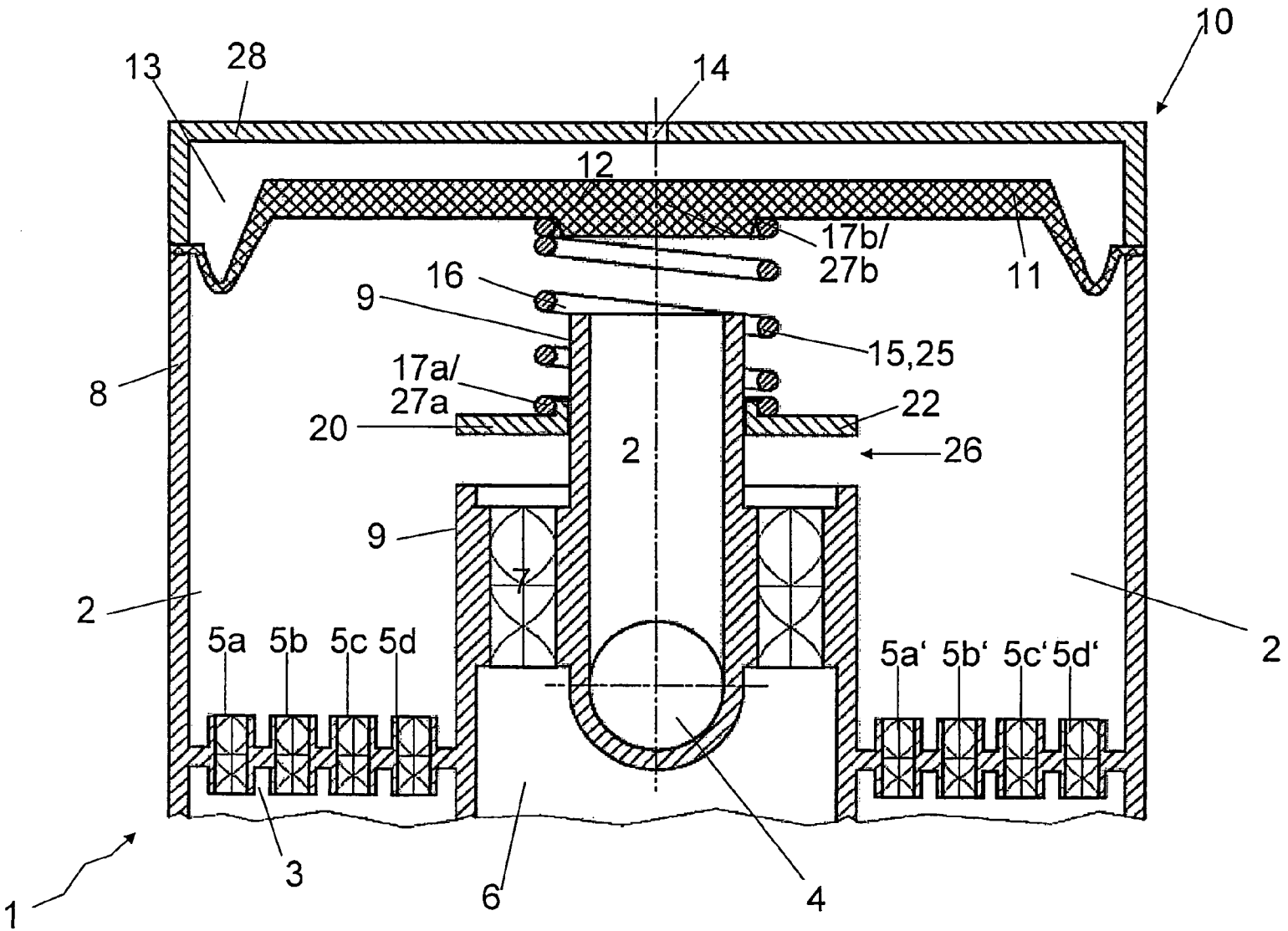

FIG. 2E illustrates the case in which the intake pipe vacuum is high and the blow-by gas flow also reaches unallowably high values. In this case, the pressure regulator valve is closed and the bypass valve 20 is simultaneously open. As a result of the opening of the bypass valve 20, on the other hand, the pressure regulator valve is held in a somewhat opened position, because the force of the bypass valve 20, via the spring 15, 25, is transmitted in the form of an opening force to the pressure regulator valve 10. Consequently, on one hand the blow-by flow is securely sucked out and on the other hand the pressure regulator valve is held sufficiently open to utilize the high intake pipe vacuum for at least partial ventilation of the crankcase.

This invention therefore makes available an oil mist separator in which both a total evacuation of the crankcase at a high vacuum and an inflation of the crankcase when there is a high blow-by gas flow are reliably prevented. Different tensions are applied to the spring of the pressure regulator valve as a result of the different membrane positions of the pressure regulator valve. This bias varies precisely in the direction in which the bias of a bypass valve is to be varied to achieve the advantages described above. In the above example, the bypass valve is installed directly next to—given an installation situation with the illustrated inclination—and underneath the spring for the bias of the membrane position of the pressure regulator valve, and for its part is biased in the closing direction by the same spring. Thus the advantages of the pressure regulator valve and of the bypass valve are realized in a single arrangement with a minimum number of components. The switch point of the two valves can therefore be influenced and/or determined by the coordination of the surface areas of the intake pipe, the bypass valve, the membrane characteristics (active surface area, thickness, material, shape, stiffness) and the strength of the spring.

In accordance with the provisions of the patent statutes, the present invention has been described in what is considered to represent its preferred embodiments. However, it should be noted that the invention can be practiced otherwise than as specifically illustrated and described without departing from its spirit or scope.

What is claimed is:

1. An oil mist separator, comprising:

a line for carrying a gas from which oil droplets and/or oil mist are to be separated from a pressure-side inlet to a suction-side outlet of the line;

at least one oil mist separator element located in the line;

a pressure regulator valve which is located in the line in the direction of flow of the gas current downstream of the at least one oil mist separator element and has a bias;

a chamber which is located next to the pressure regulator valve, whereby the pressure regulator valve opens above a specified pressure difference between the line and the chamber;

a bypass line which connects a pressure side and a suction side of the at least one oil mist separator element with each other; and a bypass valve which is located in the bypass line and has a bias which closes the bypass valve below a specified pressure difference between the suction side and the pressure side of the oil separator element, wherein the pressure regulator valve and the bypass valve are connected with each other so that the pressure regulator valve, as it closes, increases the bias of the bypass valve.

2. The oil mist separator of claim 1, wherein the bypass line emerges into the line between the at least one oil mist separator element and the pressure regulator valve.

3. The oil mist separator of claim 2, wherein the pressure regulator valve is a membrane-regulated valve with a valve body and a regulating membrane for the adjustment of the valve body, whereby the regulating membrane and/or the valve body have a bias that opens the pressure regulator valve above a specified pressure in the line upstream and/or downstream of the pressure regulator valve.

4. The oil mist separator of claim 3, wherein the pressure regulator valve has an elastic element which exerts a force to open the pressure regulating valve on the regulating membrane and/or the valve body.

5. The oil mist separator of claim 4, wherein the elastic element is a coil spring.

6. The oil mist separator of claim 5, wherein the elastic element is a progressive spring.

7. The oil mist separator of claim 6, wherein the bypass valve has a valve body, whereby the valve body has a bias that closes the bypass valve below a specified pressure difference between the pressure side and the suction side of the oil mist separator element.

8. The oil mist separator of claim 7, wherein the bypass valve has an elastic element which exerts a force on the valve body for the closing of the bypass valve.

9. The oil mist separator of claim 8, wherein the elastic element of the pressure regulator valve is simultaneously the elastic element of the bypass valve.

10. The oil mist separator of claim 6, wherein the coil spring is supported with its one end directly or indirectly on the regulating membrane and/or the valve body of the pressure regulator valve and with its other end on the valve body of the bypass valve.

11. The oil mist separator of 10, wherein between the pressure regulator valve and the bypass valve there is a transmission element which transmits the closing force of the pressure regulator valve to the bypass valve in the form of a bias.

12. The oil mist separator of claim 11, wherein the transmission element is the elastic element of the pressure regulator valve and/or the elastic element of the bypass valve.

13. The oil mist separator of claim 12, wherein the bypass valve and the pressure regulator valve are located immediately next to each other.

14. The oil mist separator of claim 13, wherein at least one additional oil mist separator element is located in the bypass line upstream of the bypass valve.

* * * * *